US006547595B2

(12) United States Patent
Tanaka

(10) Patent No.: US 6,547,595 B2
(45) Date of Patent: Apr. 15, 2003

(54) HIGH-SPEED TRANSMISSION CONNECTOR

(75) Inventor: Yukitaka Tanaka, Musashimurayama (JP)

(73) Assignee: Japan Aviation Electronics Industry Limited, Tokyo (JP)

( * ) Notice: Subject to any disclaimer, the term of this patent is extended or adjusted under 35 U.S.C. 154(b) by 0 days.

(21) Appl. No.: 10/037,374

(22) Filed: Jan. 4, 2002

(65) Prior Publication Data

US 2002/0132525 A1 Sep. 19, 2002

(30) Foreign Application Priority Data

Mar. 14, 2001 (JP) ..... 2001-72016

(51) Int. Cl.[7] ..... H01R 13/648
(52) U.S. Cl. ..... 439/607; 439/108; 439/941
(58) Field of Search ..... 439/607, 941, 439/608, 108

(56) References Cited

U.S. PATENT DOCUMENTS 6,379,184 B1 * 4/2002 Bassler et al. ..... 439/607

* cited by examiner

*Primary Examiner*—Tho D. Ta
*Assistant Examiner*—Truc Nguyen
(74) *Attorney, Agent, or Firm*—Frishauf, Holtz, Goodman & Chick, P.C.

(57) ABSTRACT

There is provided a high-speed transmission connector which is capable of achieving a match between characteristic impedances and excellent transmission characteristics for transmission of high-frequency signals and high-speed signals. The high-speed transmission connector comprises an insulator, and signal contacts and a shield contact held by the insulator. The signal contacts are arranged on opposite sides of the shield contact in a manner enclosed by a shield member continuous with the shield contact.

1 Claim, 18 Drawing Sheets

HIGH-SPEED TRANSMISSION CONNECTOR

BACKGROUND OF THE INVENTION

1. Field of the Invention

This invention relates to a high-speed transmission connector for use in a communication device or the like, which is suitable for transmission of high-frequency signals.

2. Description of the Prior Art

FIG. 11 shows a conventional high-speed transmission connector in front view, while FIG. 12 shows the same in rear view. FIG. 13 is a cross-sectional view taken on line XIII—XIII of FIG. 11. FIG. 14 shows the FIG. 11 transmission connector in side view. FIG. 15 is a cross-sectional view taken on line XV—XV of FIG. 14, while FIG. 16 is a cross-sectional view taken on line XVI—XVI of FIG. 14. FIG. 17A is a side view of an upper-section shield contact, FIG. 17B a front view of the same, and FIG. 17C and FIG. 17D are a rear view and a plan view, respectively. Further, FIG. 18A is a side view of a middle-section shield contact, FIG. 18B a front view of the same, and FIG. 18C and FIG. 18D are a rear view and a plan view, respectively.

The conventional connector includes an insulator 110 and a shield casing 120 attached to the insulator 110 in intimate contact with the same.

The insulator 110 holds signal contacts 130*a*, 130*b*, . . . (generically designated by reference numeral 130), the upper-section shield contact 140 and the middle-section shield contact 150.

A location plate 160 is fixedly secured to a rear face of the insulator 110 e.g. by press-fitting or the like. The location plate 160 has a lattice of contact through holes 161 formed therethrough. The contact through holes 161 are formed with respective tapered faces for guiding the contacts 130, 140, 150.

The signal contacts 130 and the shield contacts 140, 150 each have an intermediate portion thereof bent at a right angle (see FIGS. 17A and 18A).

Each of the signal contacts 130 and the shield contacts 140, 150 has one end portion thereof inserted through a corresponding one of the contact through holes 161 and held by the location plate 160.

The front face (right side, as viewed in FIG. 14) of the insulator 110 is formed with receiving holes 111 for connection with a mating connector, not shown.

Each of the signal contacts 130 and the shield contacts 140, 150 has the other end thereof disposed in a corresponding one of the receiving holes 111.

The signal contacts 130*a*, 130*b* and the signal contacts 130*c*, 130*d* are arranged on opposite sides of the shield contact 140 (see FIG. 13).

The signal contacts 130*e*, 130*f* and the signal contacts 130*g*, 130*h* are arranged on opposite sides of the shield contact 150.

The signal contacts 130*a*, 130*b* adjacent to each other are used to transmit paired signals.

In the above connector, however, since respective portions (designated by an arrow A in FIG. 14) of the contacts 130, 140 are, exposed between the insulator 110 and the location plate 160, characteristic impedances of the contacts, which are determined by inductances and capacitances of the respective contacts, become higher than a characteristic impedance applied to a transmission system for transmitting high-frequency signals and high-speed signals, which causes a mismatch between the characteristic impedances.

Further, the characteristic impedances of an associated pair of signal contacts 130 (e.g. the signal contacts 130*a*, 130*b*) differ from each other due to difference in distance between the shield contacts 140, 150 and the respective corresponding signal contacts 130 (the impedance of a contact arranged at a location farther from a corresponding shield contact Is higher than that of a contact arranged at a location closer to the shield contact), which causes variations in high-frequency characteristics of the associated pair of signal contacts .

As a result, losses of high-frequency signals and high-speed signals due to the mismatch between the characteristic impedances are increased, and hence transmission characteristics are considerably degraded.

SUMMARY OF THE INVENTION

It is an object of the invention to provide a high-speed transmission connector which is capable of maintaining a match between characteristic impedances and achieving excellent transmission characteristics for transmission of high-frequency signals and high-speed signals.

To attain the above object, the present invention provides a high-speed transmission connector comprising:

an insulator;

at least one shield contact held by the insulator;

at least one pair of signal contacts held by the insulation and each arranged on respective opposite sides of a corresponding one of the at least one shield contact; and a shield member enclosing the at least one pair of signal contacts and arranged continuous with the shield contact.

According to this high-speed transmission connector, since portions of the signal contacts and the shield contact, which are exposed in the prior art, are enclosed by the shield member continuous with the shield contact, the signal contacts are shielded, whereby characteristic impedances of the respective signal contacts are reduced and become equal to each other.

Preferably, the shield member is integrally formed with the shield contact.

According to this preferred embodiment, since the shield member is integrally formed with the shield contact, it is possible to prevent an increase in number of component parts of the connector.

The above and other objects, features and advantages of the present invention will become more apparent from the following detailed description taken in conjunction with the accompanying drawings.

DETAILED DESCRIPTION OF THE PREFERRED EMBODIMENTS

Next, the invention will now be described in detail with reference to drawings showing preferred embodiments thereof.

Figure 1:
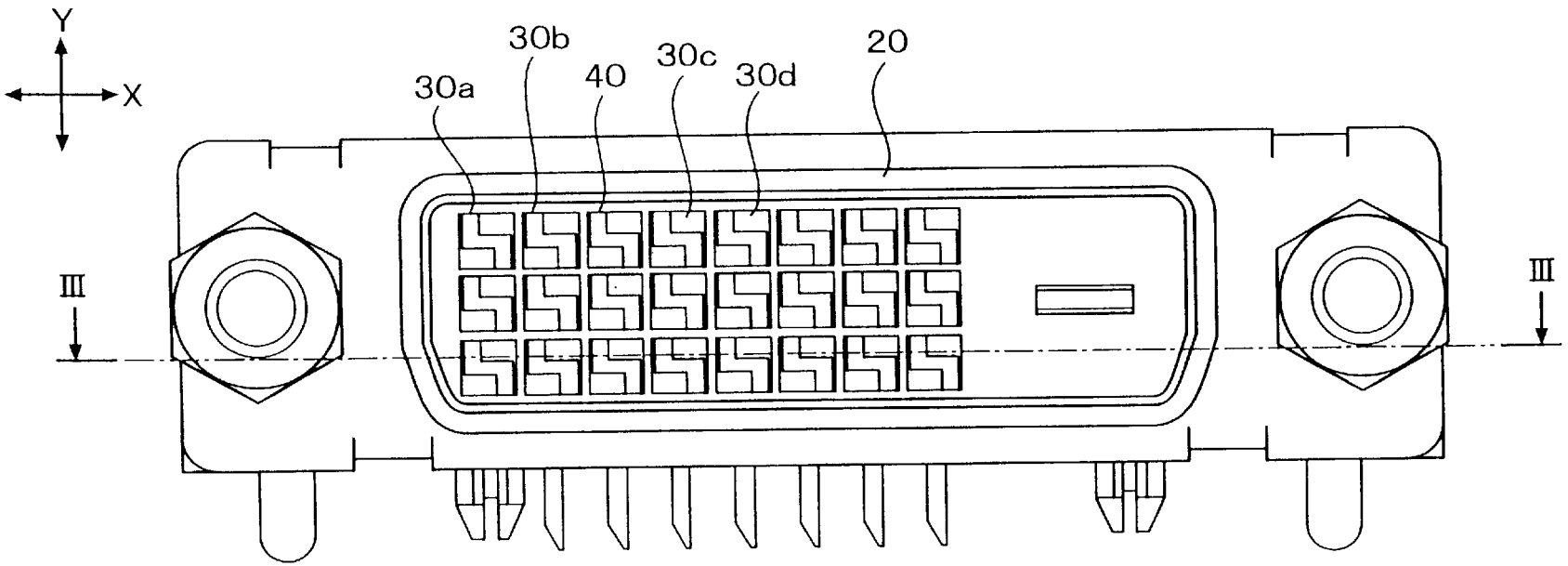
FIG. 1 is a front view of a high-speed transmission connector according to an embodiment of the invention.
Figure 2:
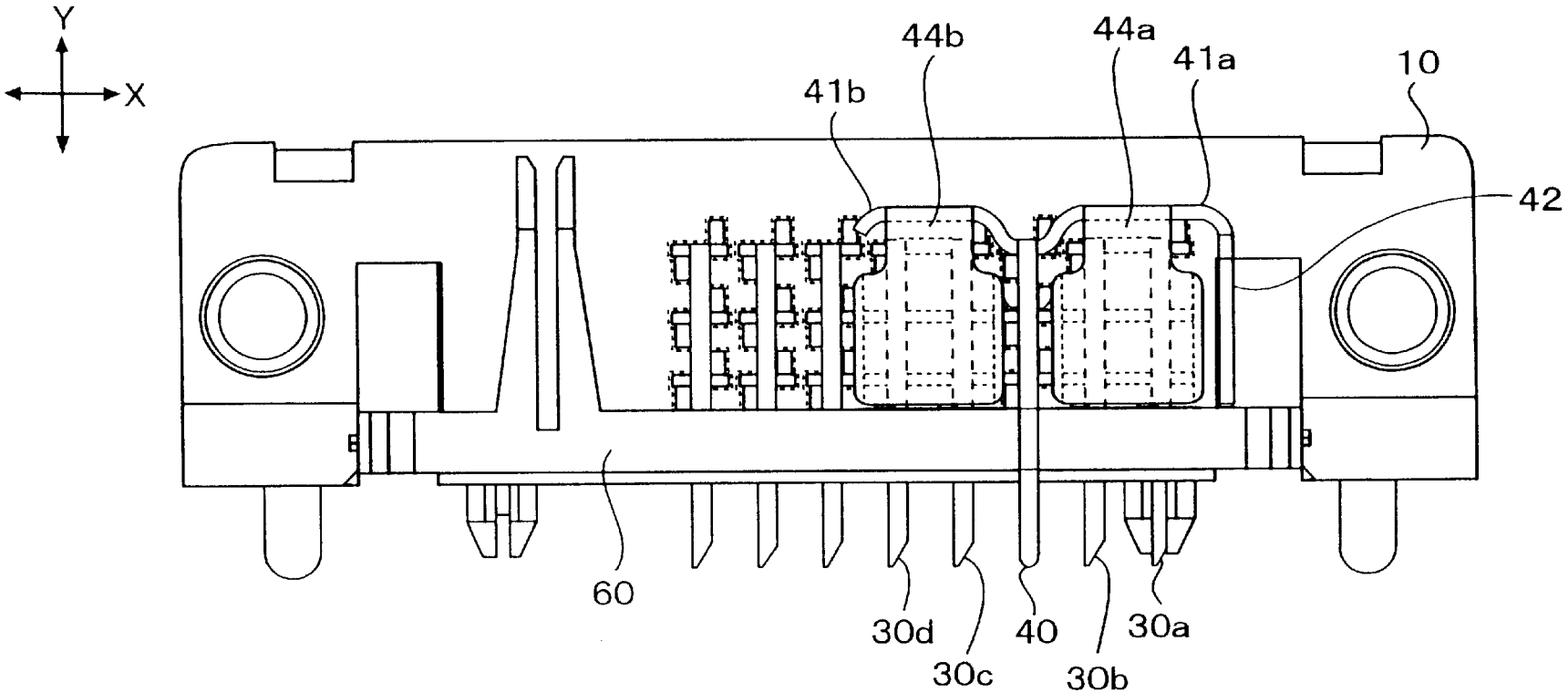
FIG. 2 is a rear view of the FIG. 1 connector.
Figure 3:
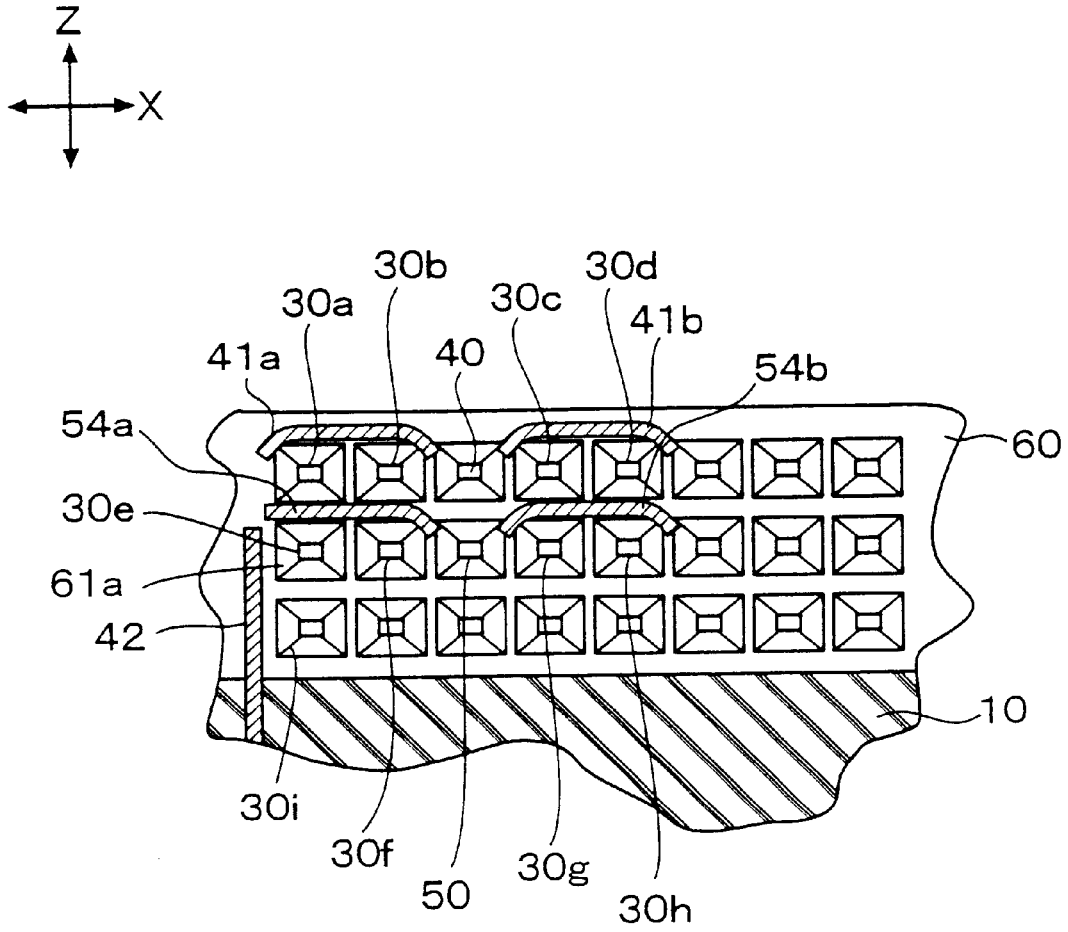
FIG. 3 is a cross-sectional view taken on line III—III of FIG. 1.
Figure 4:
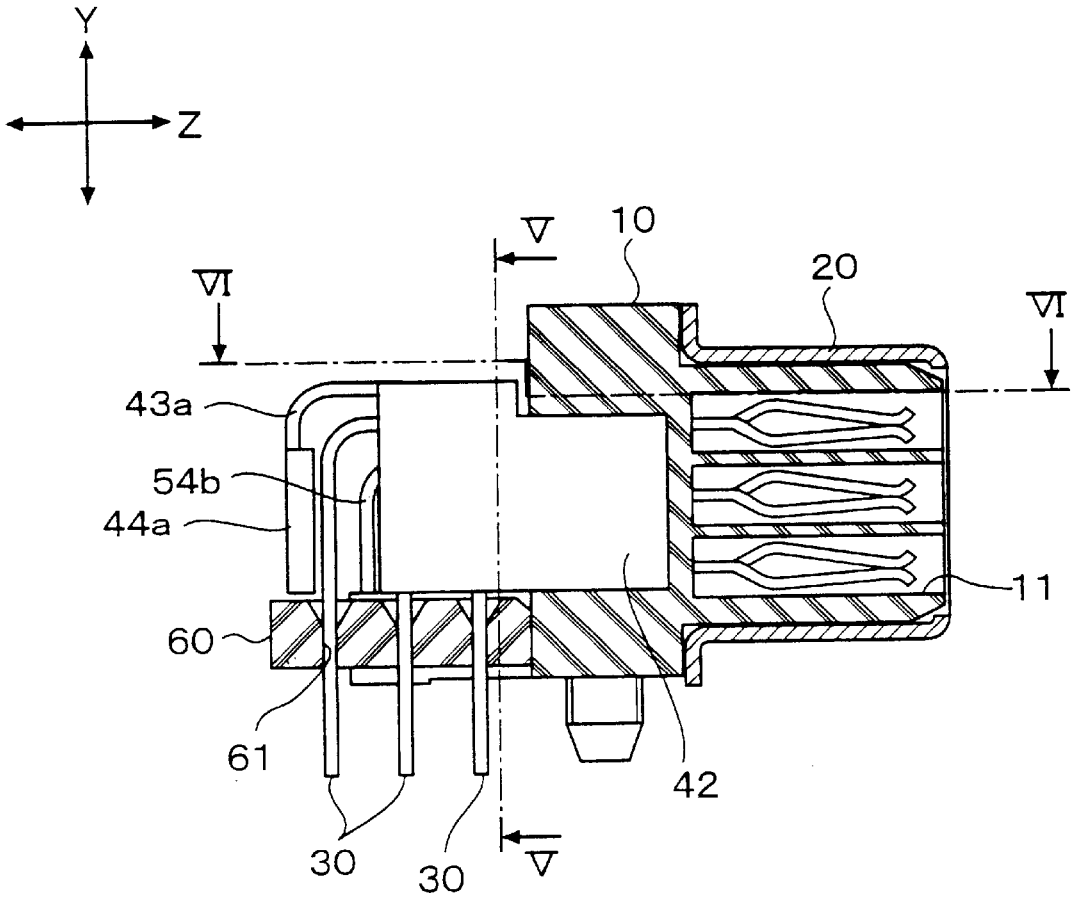
FIG. 4 is a vertical cross-sectional view of the FIG. 1 connector.
Figure 5:
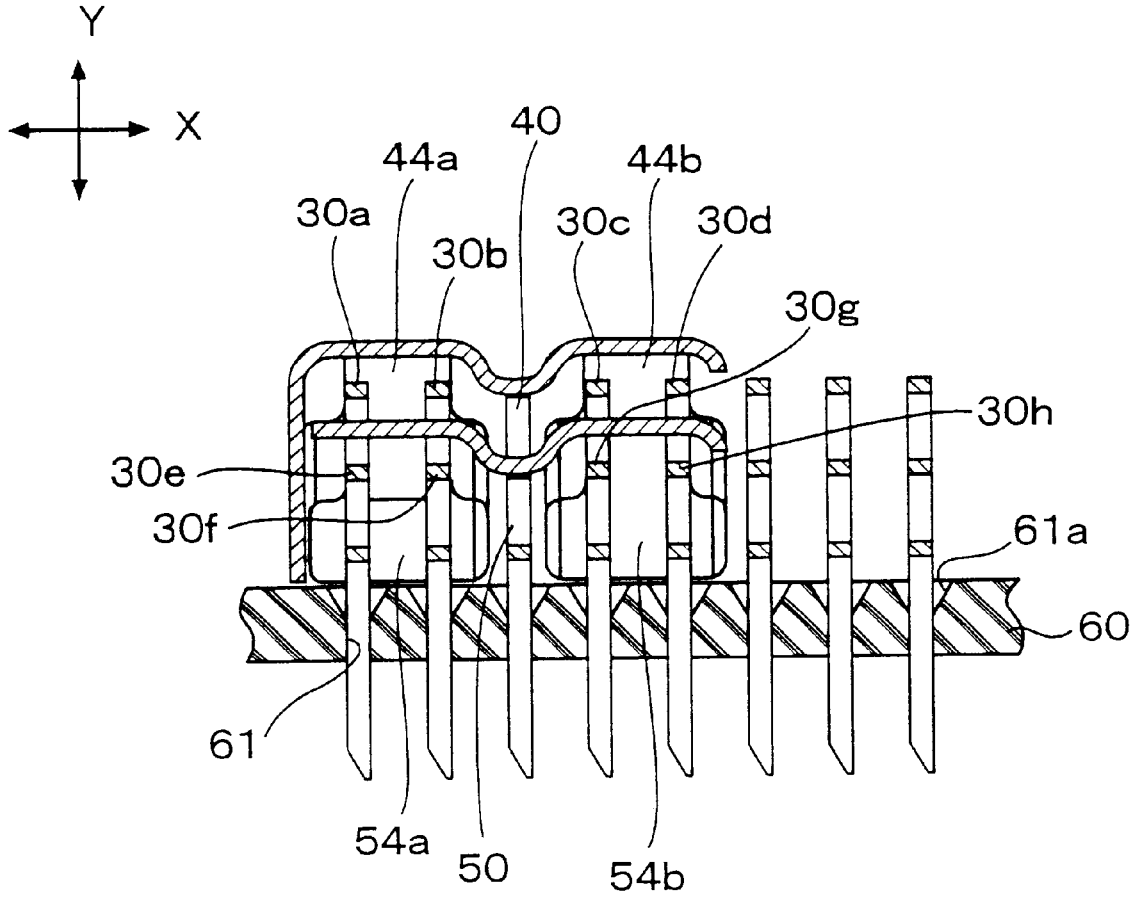
FIG. 5 is a cross-sectional view taken on line V—V of FIG. 1.
Figure 6:
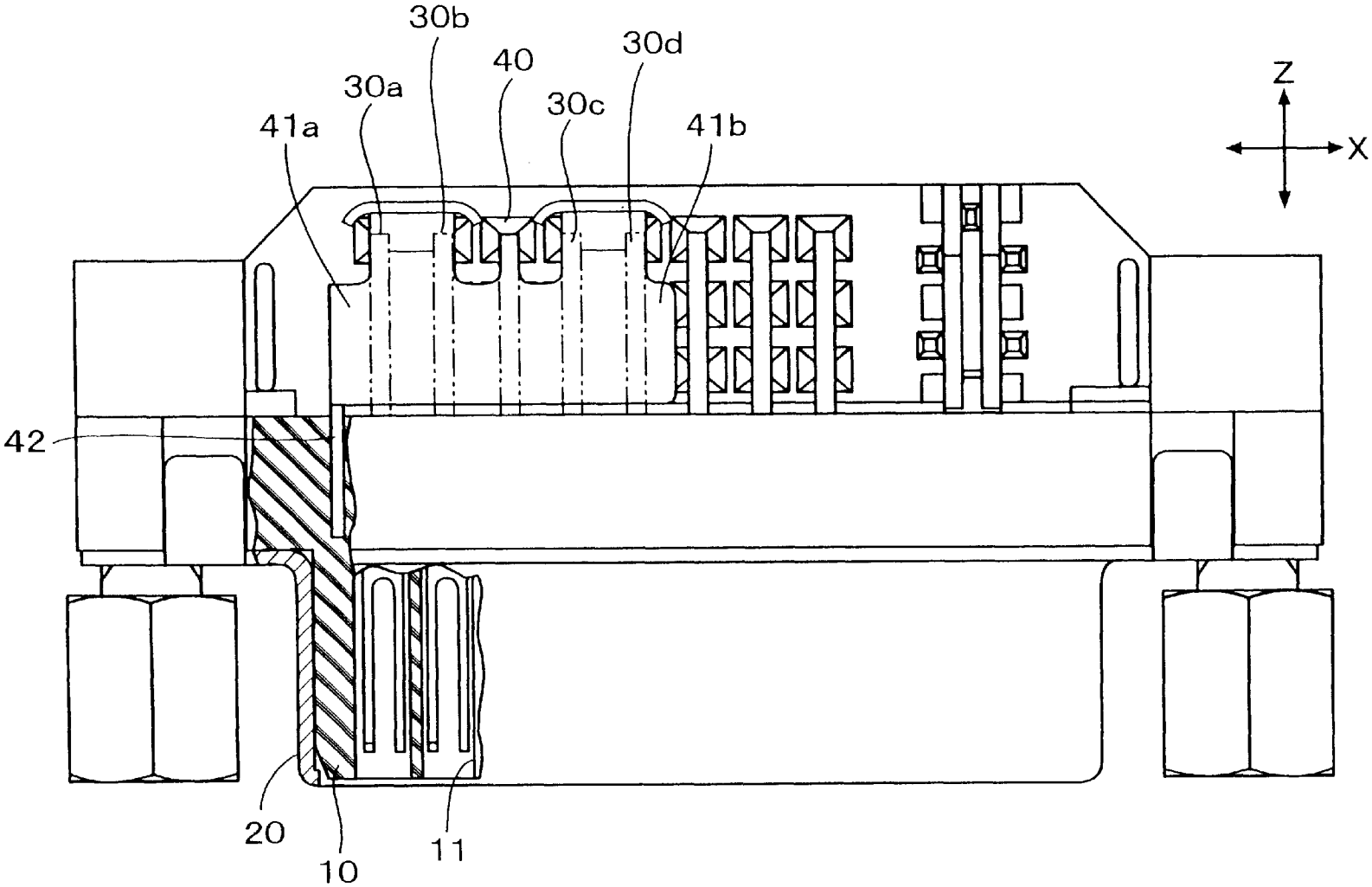
FIG. 6 is a cross-sectional view taken on line VI—VI of FIG. 1.

FIG. 1 is a front view of a high-speed transmission connector according to an embodiment of the invention. FIG. 2 is a rear view of the same, and FIG. 3 is a cross-sectional view taken on line III—III of FIG. 3. FIG. 4 is a vertical cross-sectional view of the connector. FIG. 5 is a cross-sectional view taken on line V—V of FIG. 4, while FIG. 6 is a cross-sectional view taken on line VI—VI of FIG. 4.

The connector is comprised of an insulator 10, a shield casing 20, a plurality of signal contacts 30*a*, 30*b*, . . . (generically designated by reference numeral 30), an upper-section shield contact 40 and a middle-section shield contact 50.

The shield casing 20 is attached to the front face of the insulator 10 in intimate contact therewith.

A location plate 60 is fixedly secured to a rear face of the insulator 10 by press-fitting. The location plate 60 has a lattice of contact through holes 61 formed therethrough. The contact through holes 61 are formed with respective tapered faces 61*a* for guiding one end portions of the contacts 30, 40, 50.

The one end portion of each of the signal contacts 30 and the shield contacts 40, 50 is inserted through a corresponding one of the contact through holes 61 and held by the location plate 60.

The one end portions of the signal contacts 30 and the shield contacts 40, 50 are connected to a printed circuit board, not shown.

The signal contacts 30 and the shield contacts 40, 50 each have a longitudinally intermediate portion thereof bent at a right angle.

The front face (right side, as viewed in FIG. 4) of the insulator 10 is formed with a lattice of receiving holes 11 for connection with a mating connector, not shown.

The signal contacts 30*a*, 30*b* and the signal contacts 30*c*, 30*d* are arranged in a row on the opposite sides of the shield contact 40 in an X direction.

The signal contacts 30*e*, 30*f* and the signal contacts 30*g*, 30*h* are arranged in a row in the X direction on the opposite sides of the shield contact 50.

The adjacent pairs of signal contacts 30*a*, 30*b* and signal contacts 30*c*, 30*d*, and the other paired signal contacts adjacent to each other are used to transmit paired signals.

Each of the signal contacts 30 and the shield contacts 40, 50 has the other end portion thereof disposed in a corresponding one of the receiving holes 11.

The other end portions of the signal contacts 30 and the shield contacts 40, 50 are each formed to have a tuning fork shape.

Next, the upper-section shield contact 40 and the middle-section shield contact 50 will be described.

Figure 7D:
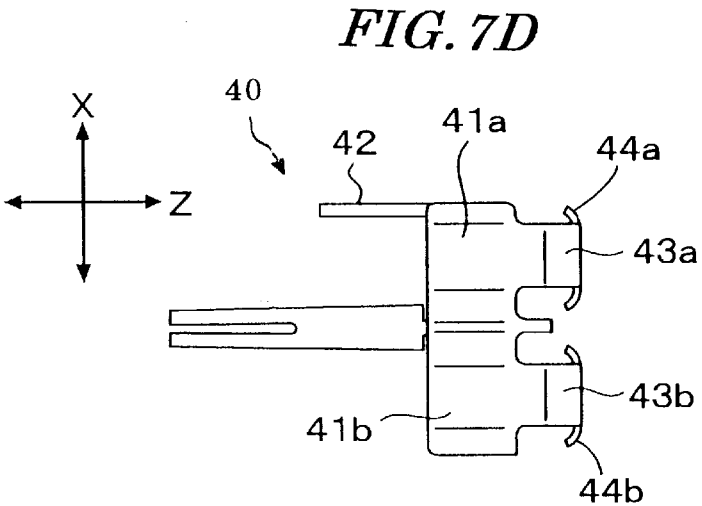
FIG. 7D is a plan view of the upper-section shield contact.
Figure 7A:
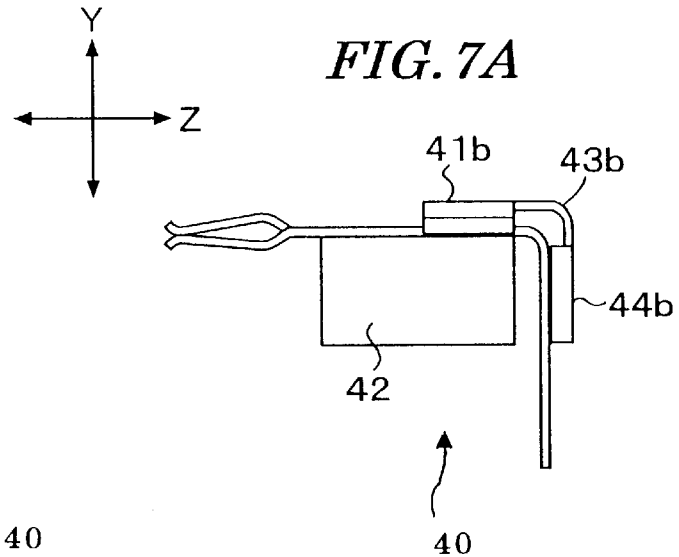
FIG. 7A is a side view of an upper-section shield contact.
Figure 7C:
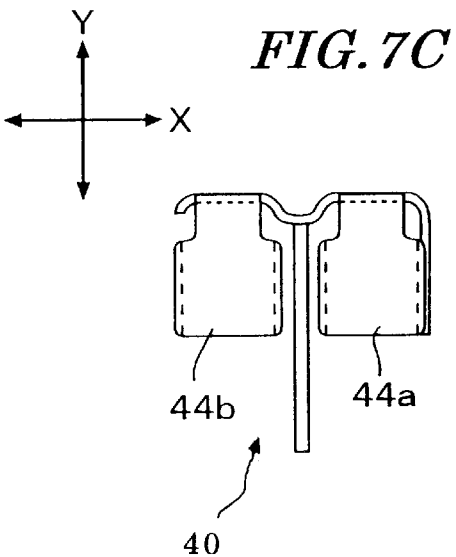
FIG. 7C is a rear view of the upper-section shield contact.
Figure 7B:
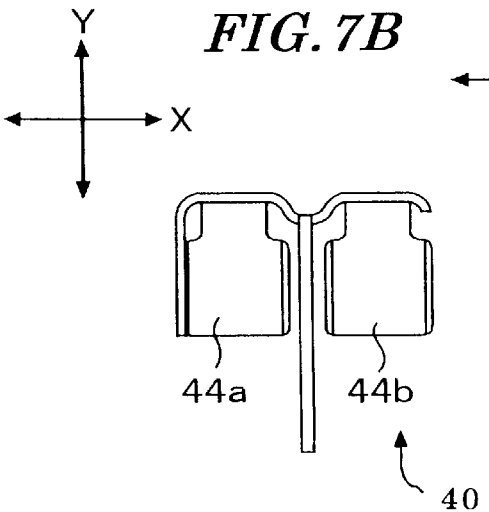
FIG. 7B is a front view of the upper-section shield contact.

FIG. 7A shows the upper-section shield contact 40 in side view, FIG. 7B shows the same in front view, FIG. 7C shows the same in rear view, and FIG. 7D shows the same in plan view.

The upper-section shield contact 40 has the intermediate portion thereof formed with first plate portions 41*a*, 41*b* extending in the X direction. The first plate portion 41*a* covers the signal contacts 30*b*, 30*a*, while the first plate portion 41*b* covers the signal contacts 30*c*, 30*d* (see FIGS. 2 and 3).

The first plate portion 41*a* has an end portion in the X direction which is formed with a generally rectangular second plate portion 42 extending in a Y direction perpendicular to the X direction in a manner shielding the signal contacts 30*e*, 30*i* (see FIG. 3).

The second plate portion 42 extends in the Y direction to a location immediately close to the location plate 60. The second plate portion 42 has part thereof supported by the insulator 10 (see FIG. 4).

The first plate portions 41*a*, 41*b* have respective end portions in a Z direction perpendicular to the X direction and the Y direction (on a rear side of the connector) which are formed with third plate portions 44*a*, 44*b* extending in the Y direction via respective arcuate portions 43*a*, 43*b* continuous with the first plate portions 41*a*, 41*b*. The third plate portions 44*a*, 44*b* extend to a location immediately close to the location plate 60 (see FIG. 4).

Each of the third plate portions 44*a*, 44*b* has opposite ends in the X direction which are each bent toward the front of the connector (see FIGS. 4, 7A, 7B). The first plate portions 41*a*, 41*b*, the second plate portion 42, the arcuate portions 43*a*, 43*b* and the third plate portions 44*a*, 44*b* form a shield member of the upper-section shield contact 40.

Figure 8D:
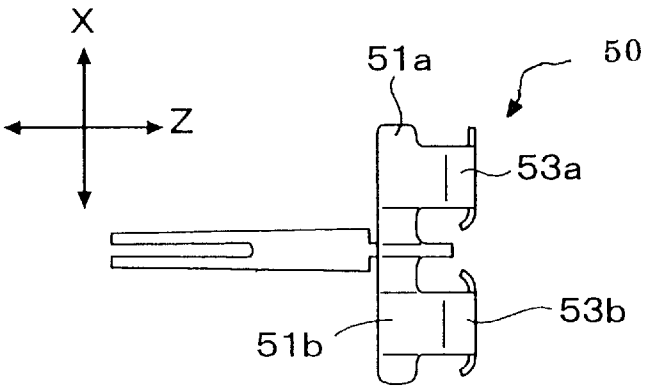
FIG. 8D is a plan view of the middle-section shield contact.
Figure 8C:
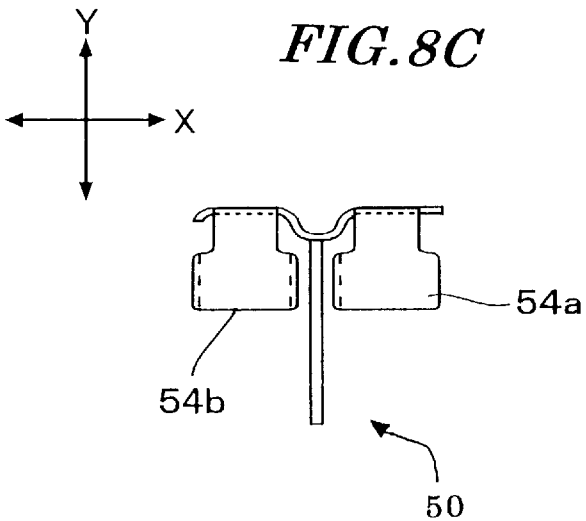
FIG. 8C is a rear view of the middle-section shield contact.
Figure 8A:
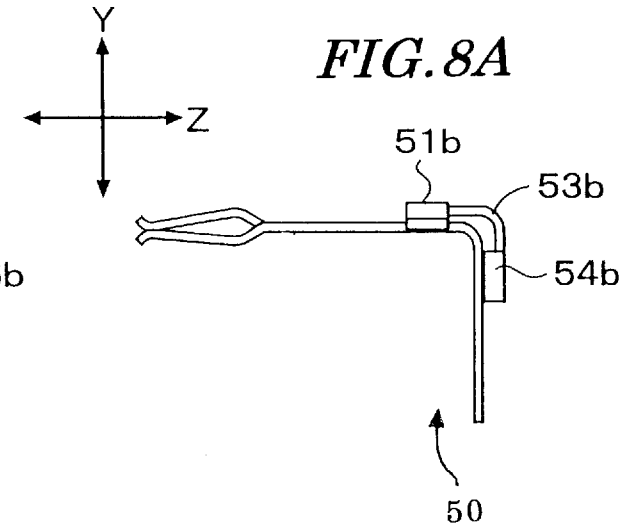
FIG. 8A is a side view of a middle-section shield contact.
Figure 8B:
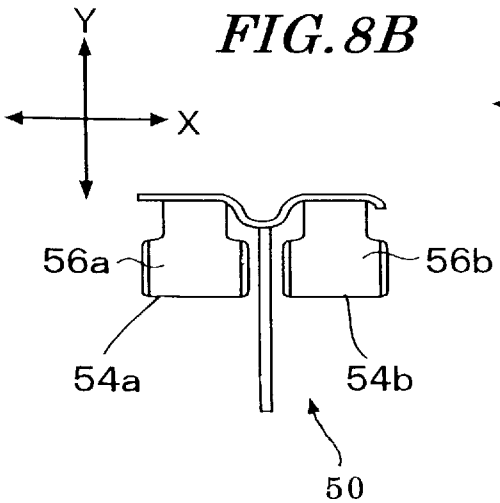
FIG. 8B is a front view of the middle-section shield contact.

FIG. 8A shows the middle-section shield contact 50 in side view, FIG. 8B shows the same in front view, FIG. 8C shows the same in rear view, and FIG. 8D shows the same in plan view.

The middle-section shield contact 50 has the intermediate portion thereof formed with first plate portions 51*a*, 51*b* extending in the X direction. The first plate portion 51*a* covers the signal contacts 30*f*, 30*e*, while the first plate portion 51*b* covers the signal contacts 30*g*, 30*h* (see FIG. 3).

The first plate portions 51*a*, 51*b* have respective end portions in the Z direction (on the rear side of the connector) which are formed with second plate portions 54*a*, 54*b* extending in the Y direction via respective arcuate portions 53*a*, 53*b* continuous with the first plate portions 51*a*, 51*b*. The second plate portions 54*a*, 54*b* each extend to a location immediately close to the location plate 60 (see FIG. 4)

The second plate portions 54*a*, 54*b* each have an end portion in the X direction which is bent toward the front of the connector (see FIGS. 8A, 8B).

The first plate portions 51*a*, 51*b*, the arcuate portions 53*a*, 53*b* and the second plate portions 54*a*, 54*b* form a shield member of the middle-section shield contact 50.

This construction makes it possible to change the distance between a signal contact and a shield member associated therewith to thereby change the characteristic impedance of the signal contact which is determined by inductance and capacitance thereof. For example, the characteristic impedance of the signal contact 30*a* arranged at a location farther from the shield contact 40 and the signal contact 30*b* arranged at a location closer to the same can be made equal with each other.

Further, it is possible to shield the signal contacts 30*a* to 30*h* by the shield members, thereby reducing the characteristic impedance between the insulator 10 and the location plate 60, where impedance mismatches occur.

According to the present embodiment, it is possible to adjust variation in the high-frequency characteristic of each transmission line by the associated shield member to thereby adjust the characteristic impedance of the whole of the signal contacts 30 to a desired value (e.g. 50 ), so that the characteristic impedance can be matched, and hence improvement of the high-frequency characteristics (increase in the amount of insertion propagation, reduction of reflection loss, and reduction of propagation delay) can be achieved, which ensures excellent propagation characteristics for transmission of high-frequency signals and high-speed signals.

Further, since the shield members are integrally formed with the respective shield contacts 40, 50, it is possible to prevent man-hours for assembly from being increased due to an increase in number of component parts of the connector, thereby reducing manufacturing costs.

Although in the above embodiment, the shield members are integrally formed with the respective shield contacts 40, 50, the former may be formed as members separate from the latter. In this case, first, the contacts 30, 40, 50 are mounted to the insulator 10, and then the shield members are press-fitted into the insulator 10 for contact with the shield contacts 40, 50. According to this construction, the construction of a die can be simplified, which facilitates manufacturing of the die.

Further, the shield members may be each formed to have a cylindrical shape. In this case, signal contacts are disposed within each of the cylindrical shield members to form a quasi-coaxial structure.

Moreover, impedance matching for a cable for wiring the signal contacts may be achieved by the shield members of the shield contacts.

Figure 9:
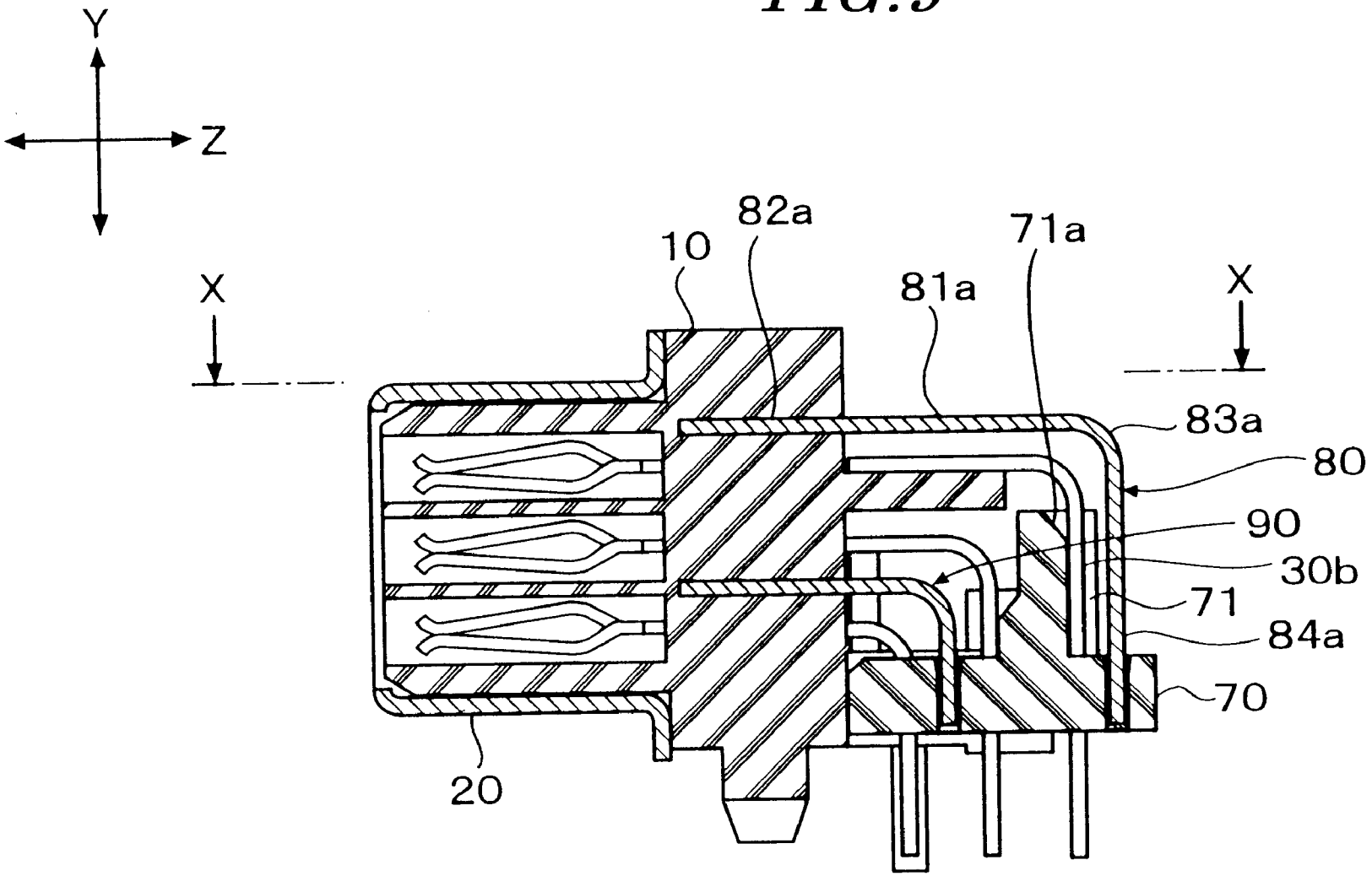
FIG. 9 is a vertical cross-sectional view of a variation of the high-speed transmission connector according to the embodiment of the invention.
Figure 10:
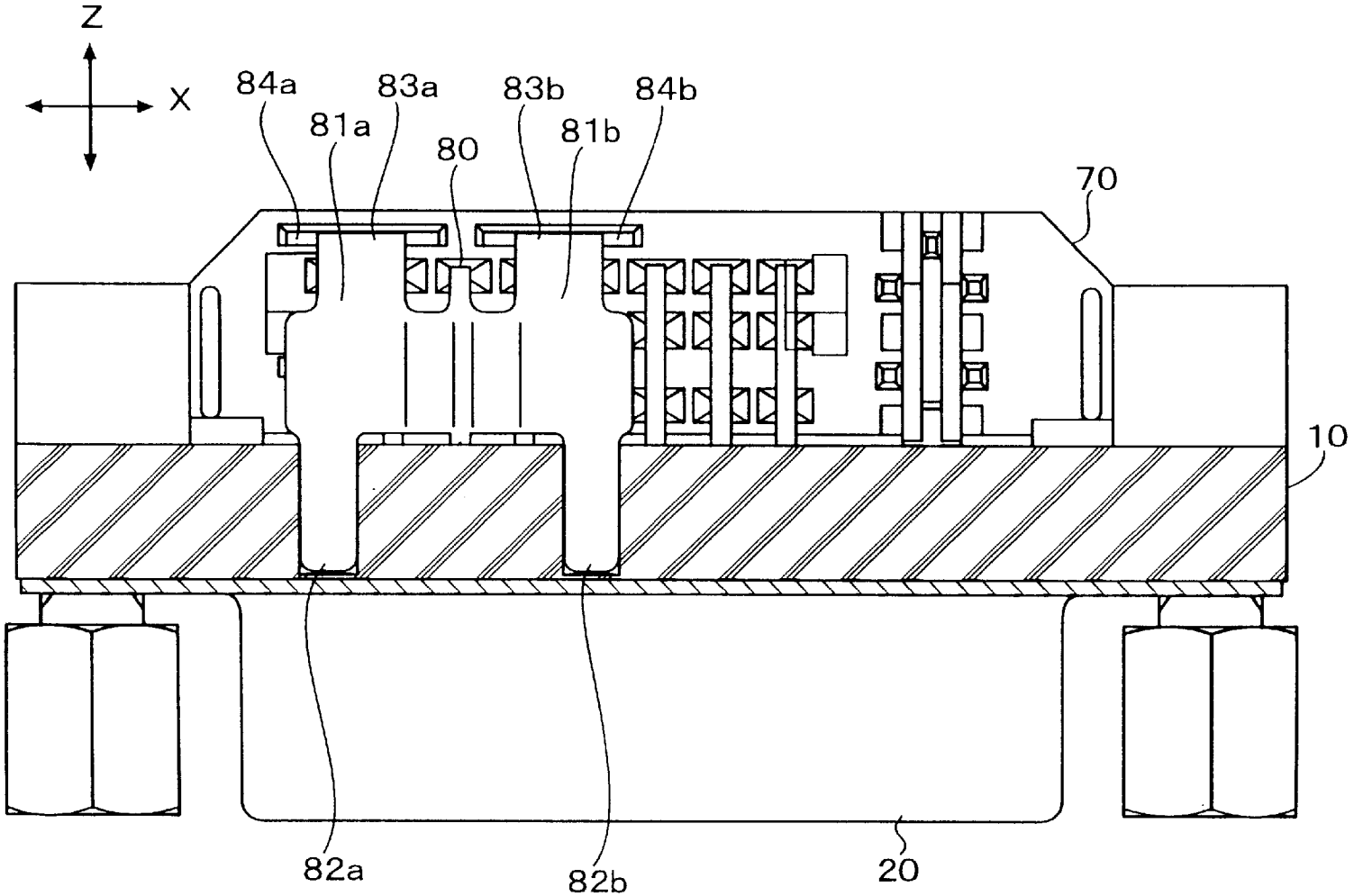
FIG. 10 is a cross-sectional view taken on line X—X of FIG. 9.
Figure 11:
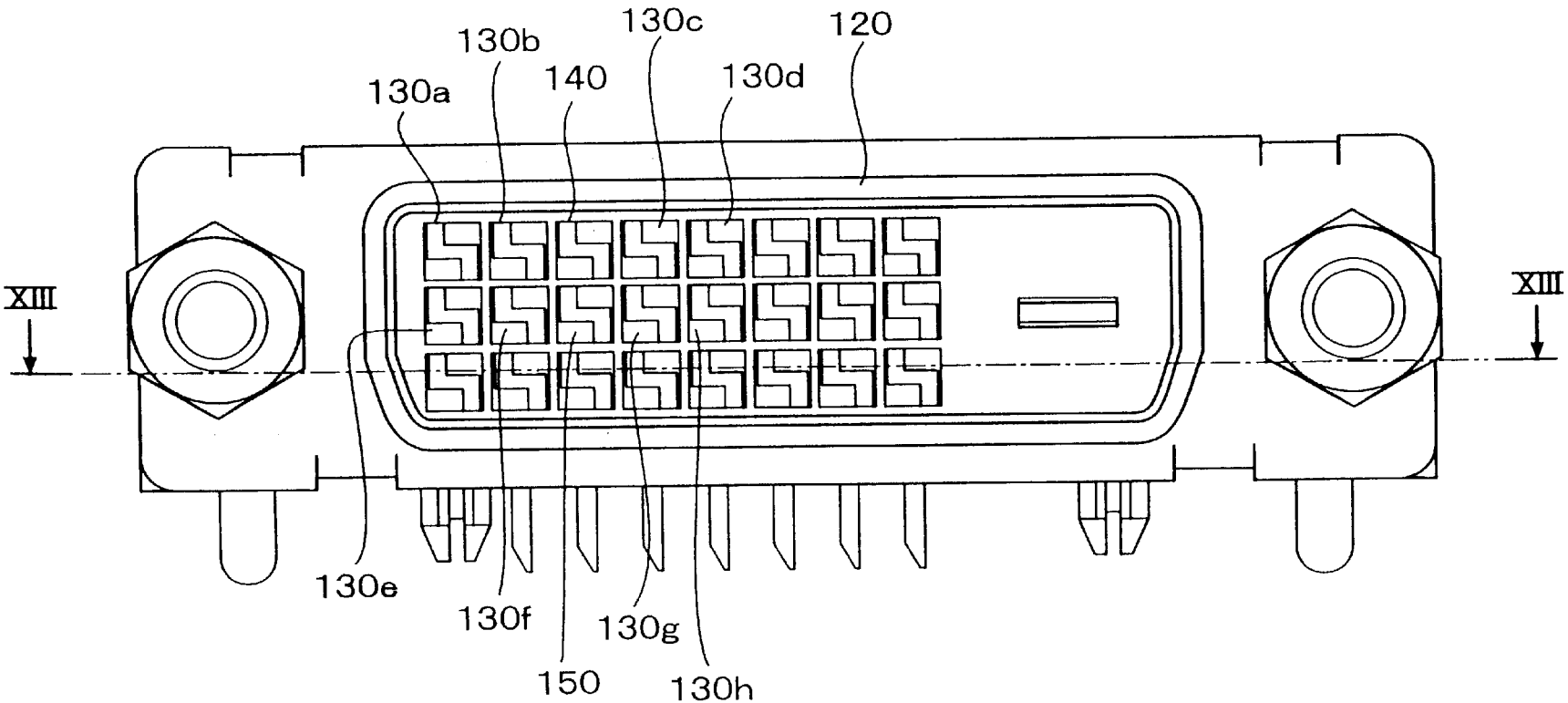
FIG. 11 PRIOR ART
FIG. 11 is a front view of a conventional high-speed transmission connector.
Figure 12:
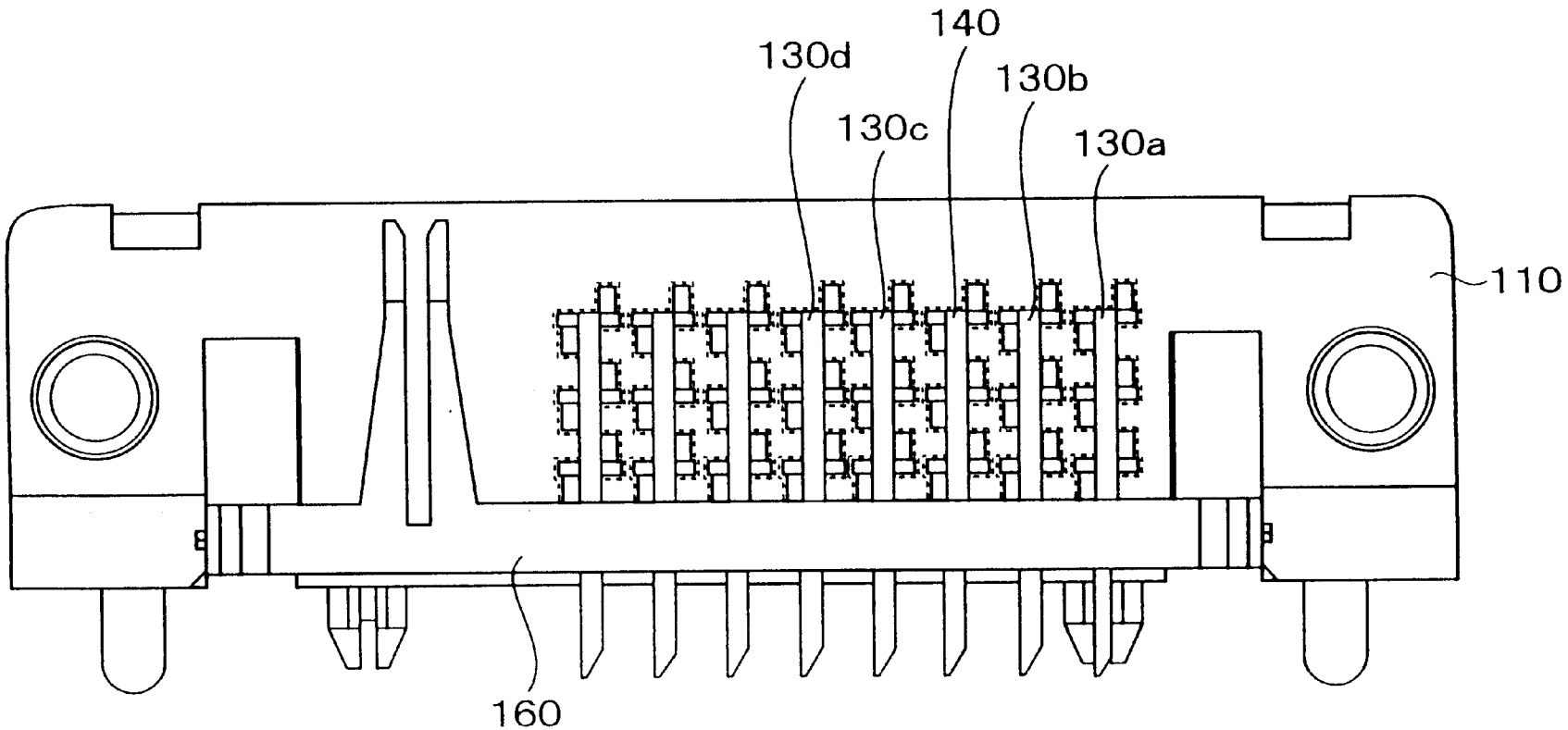
FIG. 12 PRIOR ART
FIG. 12 is a rear view of the FIG. 11 connector.
Figure 13:
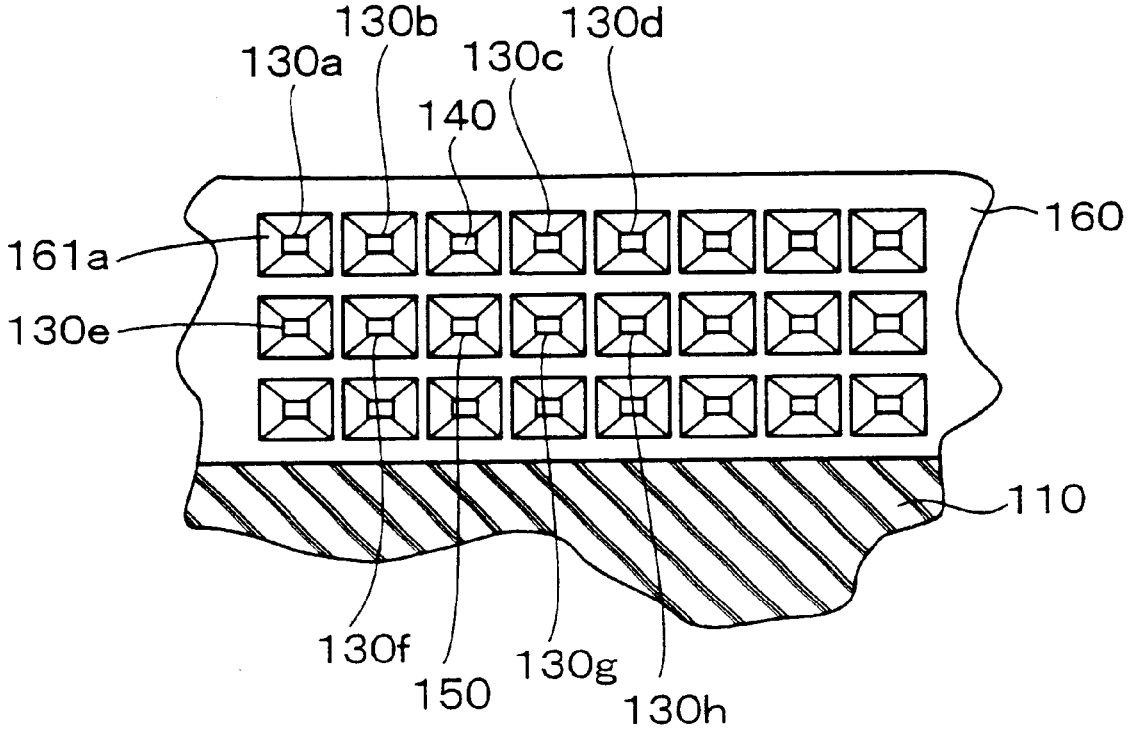
FIG. 13 PRIOR ART
FIG. 13 is a cross-sectional view taken on line XIII—XIII of FIG. 11.
Figure 14:
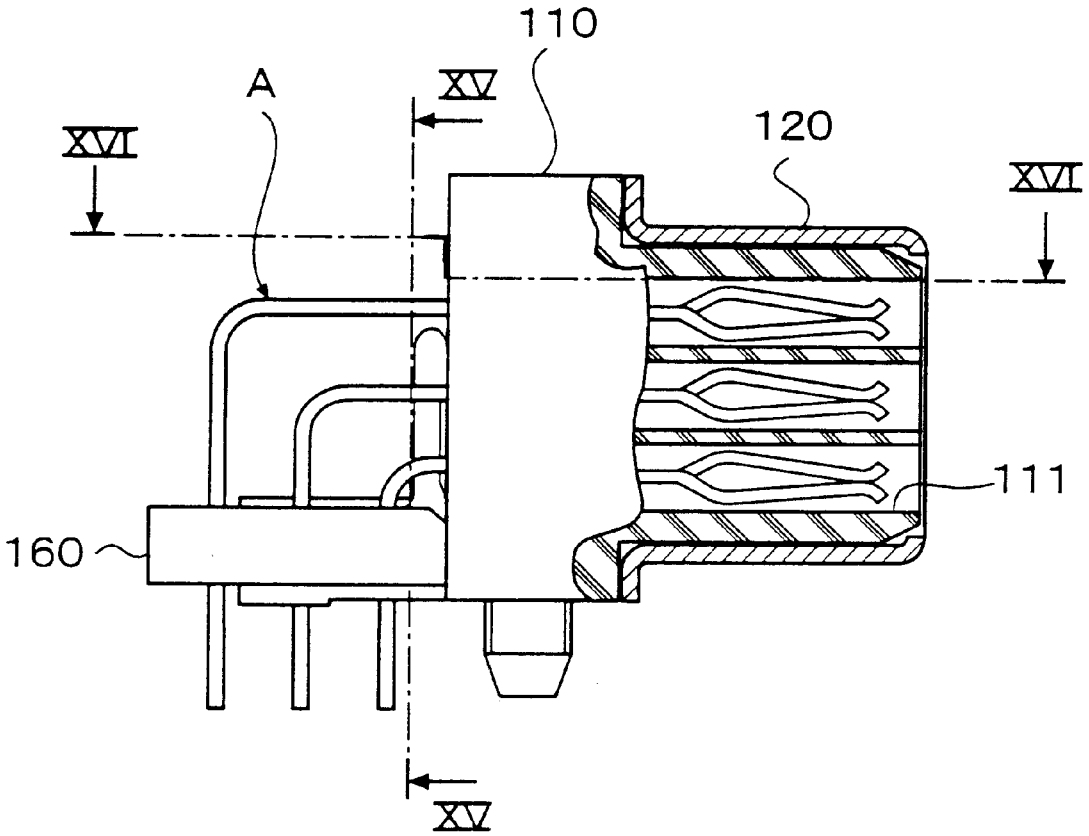
FIG. 14 PRIOR ART
FIG. 14 is a side view of the FIG. 11 connector with parts broken away.
Figure 15:
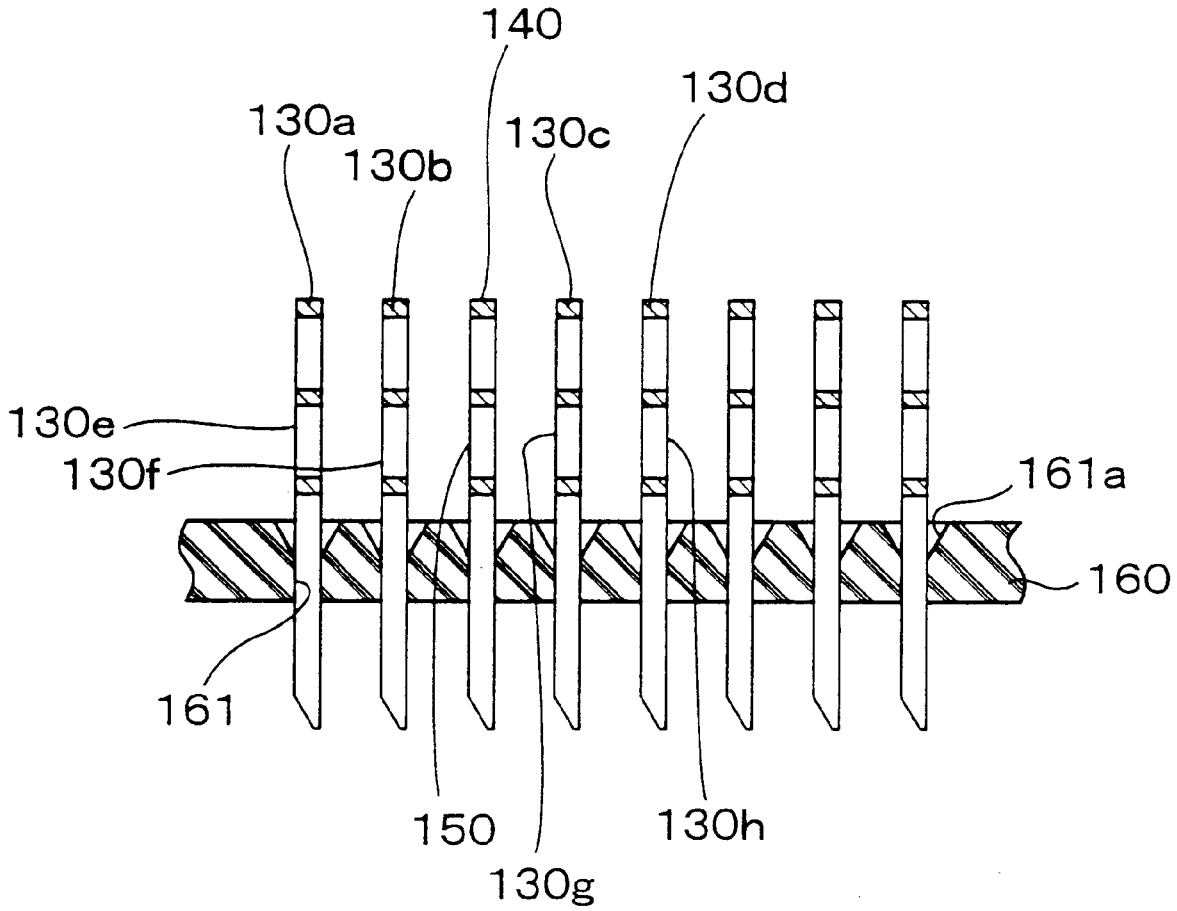
FIG. 15 PRIOR ART
FIG. 15 is a cross-sectional view taken on line XV—XV of FIG. 14.
Figure 16:
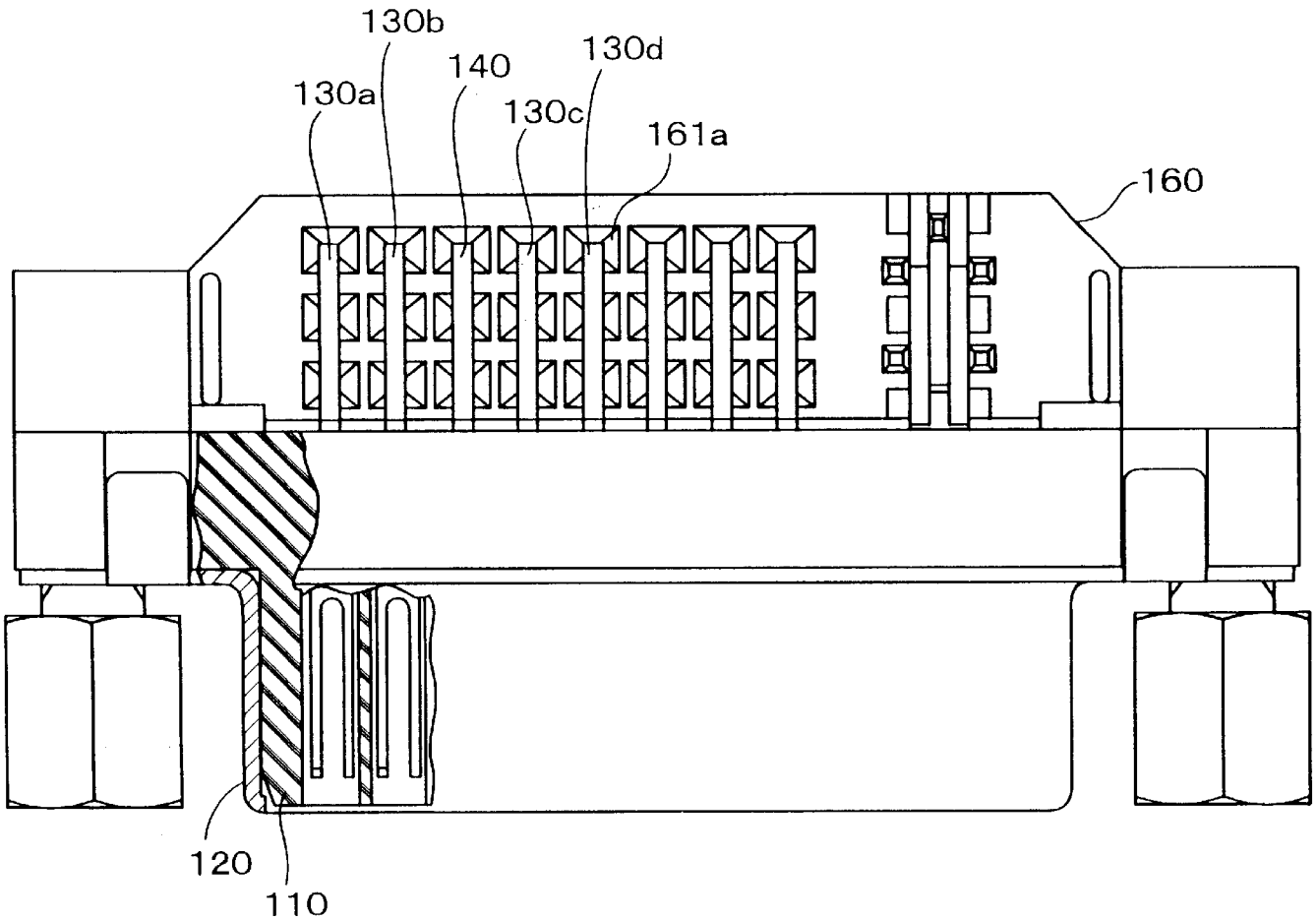
FIG. 16 PRIOR ART
FIG. 16 is a cross-sectional view taken on line XVI—XVI of FIG. 14.
Figure 17D:
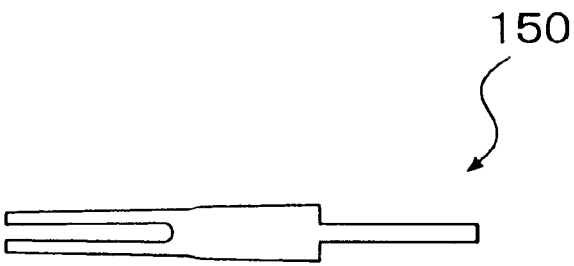
FIG. 17D PRIOR ART
FIG. 17D is a plan view of the upper-section shield contact.
Figure 17A:
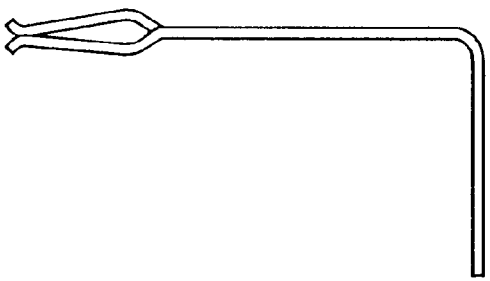
FIG. 17A PRIOR ART
FIG. 17A is a side view of an upper-section shield contact.
Figure 17B:
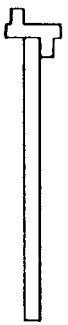
FIG. 17B PRIOR ART
FIG. 17B is a front view of the upper-section shield contact.
Figure 17C:
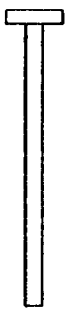
FIG. 17C PRIOR ART
FIG. 17C is a rear view of the upper-section shield contact.
Figure 18D:
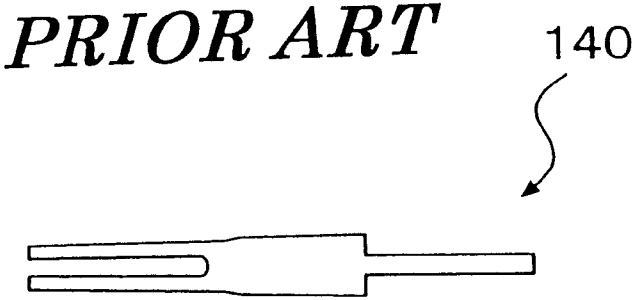
FIG. 18D PRIOR ART
FIG. 18D is a plan view of the middle-section shield contact.
Figure 18A:
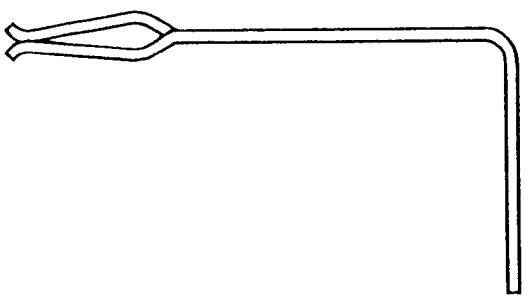
FIG. 18A PRIOR ART
FIG. 18A is a side view of a middle-section shield contact.
Figure 18B:
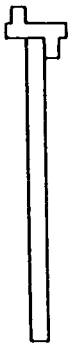
FIG. 18B PRIOR ART
FIG. 18B is a front view of the middle-section shield contact.
Figure 18C:
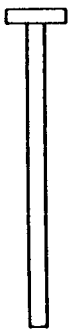
FIG. 18C PRIOR ART
FIG. 18C is a rear view of the middle-section shield contact.

FIG. 9 is a variation of the vertical cross-sectional view of a high-speed transmission connector according to the embodiment of the invention, and FIG. 10 is a cross-sectional view taken on line X—X of FIG. 9. Component parts and elements similar to those of the above embodiment are designated by identical reference numerals, and detailed description thereof is omitted.

An upper-section shield contact 80 has an intermediate portion thereof formed with first plate portions 81*a*, 81*b* extending in the X direction. The first plate portion 81*a* covers signal contacts 30*b*, 30*a*, while the first plate portion 81*b* covers signal contacts 30*c*, 30*d* (see FIG. 10). The signal contacts 30*b*, 30*a*, 30*c*, 30*d* are not seen in FIG. 10.

The first plate portions 81*a*, 81*b* have respective one end portions in the Z direction (on the front side of the connector) which are formed, respectively, with generally rectangular second plate portions 82*a*, 82*b* extending in the Z direction. The second plate portions 82*a*, 82*b* are fixedly secured to the insulator 10 by press-fitting (see FIGS. 9 and 10).

The first plate portions 81*a*, 81*b* have respective other end portions in the Z direction (on the rear side of the connector) which are formed with third plate portions 84*a*, 84*b* extending in the Y direction via respective arcuate portions 83*a*, 83*b* continuous with the first plate portions 81*a*, 81*b*. The third plate portions 84*a*, 84*b* are fixedly secured to a location plate 70 e.g. by press-fitting (see FIG. 9).

The first plate portions 81*a*, 81*b*, the second plate portion 82*a*, 82*b*, the arcuate portions 83*a*, 83*b* and the third plate portions 84*a*, 84*b* form a shield member of the upper-section shield contact 80.

The construction of a middle-section shield contact 90 is generally identical to that of the upper-section shield contact 80 except that the middle-section shield contact 90 has first and third plate portions shorter than those of the upper-section shield contact 80, and hence detailed description thereof is omitted.

The location plate 70 is formed with stepped portions such that the height of the location plate 70 is increased step by step in a direction away from the insulator 10. Each of the stepped portion is formed with contact through holes 71. The contact through holes 71 are formed in lattice, as viewed in plan view. The contact through holes 71 has respective tapered faces 71*a* formed for guiding one end portions of the corresponding contacts 30, 80, 90, respectively.

This variation can provide the same effects as obtained by the above embodiment.

It is further understood by those skilled in the art that the foregoing is the preferred embodiment of the invention, and that various changes and modification may be made without departing from the spirit and scope thereof.

What is claimed is:

1. A high-speed transmission connector comprising:

an insulator;

at least one shield contact held by said insulator, each said shield contact comprising a first set of first and second shield plates and a second set of first and second shield plates; and at least two pairs of signal contacts held by said insulator and each arranged on respective opposite sides of a corresponding one of said at least one shield contact, each said signal contact comprising a connection portion and a mating portion which is substantially perpendicular to said connection portion;

wherein each of said first and second shield plates partially encloses the connection portion and mating portion, respectively, of one of said signal contacts.

* * * * *